US006704943B2

(12) United States Patent
Calonge Clavell

(10) Patent No.: US 6,704,943 B2
(45) Date of Patent: Mar. 16, 2004

(54) INNER CUSHIONS FOR HELMETS

(75) Inventor: Rafael Calonge Clavell, Barcelona (ES)

(73) Assignee: Kisiel Technologies, S.L., Llinars Del Valles (ES)

( * ) Notice: Subject to any disclaimer, the term of this patent is extended or adjusted under 35 U.S.C. 154(b) by 0 days.

(21) Appl. No.: 10/035,841

(22) Filed: Dec. 31, 2001

(65) Prior Publication Data

US 2003/0131400 A1 Jul. 17, 2003

(51) Int. Cl.[7] ..... A42B 3/00
(52) U.S. Cl. ..... 2/411; 2/414; 428/312.2
(58) Field of Search ..... 2/411, 412, 414; 428/312.2, 312.6, 319.1

(56) References Cited

U.S. PATENT DOCUMENTS 2,709,810 A * 6/1955 Dye ..... 2/414
3,607,797 A * 9/1971 Rubens et al. ..... 521/59
3,616,463 A * 11/1971 Theodore et al. ..... 2/412
3,877,076 A * 4/1975 Summers et al. ..... 2/414
3,946,441 A * 3/1976 Johnson ..... 2/412
4,072,635 A * 2/1978 Jeram ..... 523/218
4,486,901 A * 12/1984 Donzis ..... 2/462
4,619,003 A * 10/1986 Asbury ..... 2/5
5,633,286 A * 5/1997 Chen ..... 2/411
5,699,561 A * 12/1997 Broersma ..... 2/412
5,734,994 A * 4/1998 Rogers ..... 2/411
6,093,468 A * 7/2000 Toms et al. ..... 2/411
6,332,226 B1 * 12/2001 Rush, III ..... 2/412
6,358,459 B1 * 3/2002 Ziegler et al. ..... 264/413
2002/0023291 A1 * 2/2002 Mendoza ..... 2/412

* cited by examiner

*Primary Examiner*—Rodney M. Lindsey
(74) *Attorney, Agent, or Firm*—Steinberg & Raskin, P.C.

(57) ABSTRACT

The present invention relates to an inner cushion for helmets. The inner cushion includes an shock absorbing composite sandwiched between two protecting foils. The composite includes at least one absorbing material for absorbing an impact energy, wherein the at least one absorbing material is structured and arranged to absorb the impact energy by being crushed and collapsed upon exposure to the impact energy and diffusing air through a network of pores in the absorbing material.

15 Claims, 1 Drawing Sheet

INNER CUSHIONS FOR HELMETS

TECHNICAL FIELD

The present invention proposes an Inner Cushion (IC) for helmets having a shock absorbing padding consisting of either an inorganic (i.e. containing silica aerogel) or organic (i.e. containing carbon aerogel, an RF aerogel, a viscoelastic polymer foam, etc.) composite foam, mixed with other Organic or Mineral Foam and an external metal or metal-polymer foil protector in both sides.

BACKGROUND OF THE INVENTION

The majority of helmet manufacturers utilize EPS (Expanded Polystyrene) or EPP (Expanded Polypropylene) materials for absorbing impacts. Those materials provide a good kinematic behavior in the head deceleration, but from the dynamic point of view, the stored energy in the elastic material will be returned to the deforming agent, i.e. the head, producing further damages to the brain.

Two common causes of brain damage are head wounds and severe blows to the head. Head wounds describe wounds which actually extend into the brain itself, such as might be the case if a person was shot in the head or if they suffered a crush in part of the skull in an accident. If the skull becomes broken then the brain is vulnerable to direct damage, this is an open head injury. Alternatively, the brain may become damaged even if the skull remains intact if the head receives a very severe blow—a closed head injury. In such cases the damage can be both from the direct strike against the inside of the skull (coup) or from the resulting forces of rotation which cause the brain to strike against the skull at the opposite side of the head (countercoup). These two types of injuries constitute the two most common causes of brain damage in young adults (often resulting from car or motorbike accidents). A further complication of closed head injury is the fact that local neurons tend to develop edema where neurons close to the site of injury swell, retain fluid and become less excitable.

A head impact, depending on the deceleration, on the shape of the impacting agent or the presence of a protecting helmet, can follow with a perforation, or not, of the skull. Thus, there can be immediate damage to the head by a cranial fracture and direct brain injures. But, on the other hand, there are many damaging effects produced by further accelerations undergone by the brain until the whole body becomes completely stopped. These subsequent translations, rotations and distentions produce tears, slippings, squashings and other destroying injuries in the brain. These injuries subsequently can give rise to vein squashings, cellular damage, hemorrhages and ischemia. The final edema generates in a few days a brain necrosis in the surrounding area of the first impact, even with the best treatments (i.e. citicoline). It's the opinion of the best specialists on craneo-encephalic traumatisms that brain damage due to 'bounce effects' are even more important than those ones produced by the first impact. It should be pointed out that preserving any small part of the brain from damage implies a considerable improvement in the quality of life for the accident victims. We should not forget the huge social and sanitary costs of treating and maintaining persons with reduced brain activity.

SUMMARY OF THE INVENTION

The present invention proposes the utilization of composite foams, as those made with aerogels, in helmets to take up (better than store and release) kinetic energy and eliminate the 'bounce back on head' effect. These foams, sandwiched between protecting foils, constitute the core of Inner Cushions which fill the gap between the head to be protected and the external outer shell.

It's the purpose of this invention to provide a method to absorb the impact energy by using a stiff inner cushion consisting mainly of a mechanically inelastic material.

The absorbing impact energy materials referred in this invention use two different mechanisms to convert kinetic energy into heat:

a) Crushing of the structure of the material, i.e. silica aerogel is like foamed glass, the collapse of the dentritic structure surrounding pores needs lot of energy, finally converted in heating the crushed material.

b) Diffuse air in the intricate network of pores, i.e. silica aerogels contain an open network of pores in the mesopore range, the fast diffusion of air through the pore network during the collapsing of the material generates turbulences in the microscopic scale converting kinetic energy in heated air.

It's also a purpose of this invention to protect the filling materials of the cushion by two covering foils made either by a metal, i.e. aluminum, or a metal-polymer film, i.e. mylar.

It's also a purpose of this invention to provide possible methods to establish the integrity of the stiff inner cushion, i.e. testing the electrical capacitance of the protecting foils, which is related with the average distance between the foils and the dielectric performance of the cushion containing material.

It's also a purpose of this invention to provide a fire-resisting inner padding, which could protect even at temperatures as high as 500° F. with a suitable flame resistance lining material.

The purpose of this invention is to provide inner cushions for helmets with-lower or equal weight than those existing in the market.

From the medical point of view, the purpose of this invention is to improve the protecting performance of the existing helmet cushions, mainly made with expanded polystyrene and expanded polypropylene, by using composite foam materials as fillers which finally reduce the effects of bounce back on the head such as diffuse axonal injuries, hypoxia, ischemia, blood vessels shearing and other damaging brain effects derived from head impacts.

The purpose of this invention is to improve the coma values in the Glasgow scale of head injured victims and allow a better quality of life in the post-traumatic period.

The purpose of this invention is also to adapt the mechanical properties of the cushion and its density by varying the materials composition depending on the expected application of the helmet, in particular in relationship with the maximum deceleration envisaged, i.e. bikes, skates, motorbikes, racing cars.

DETAILED DESCRIPTION OF THE PREFERRED EMBODIMENTS

Figures 1, 2:
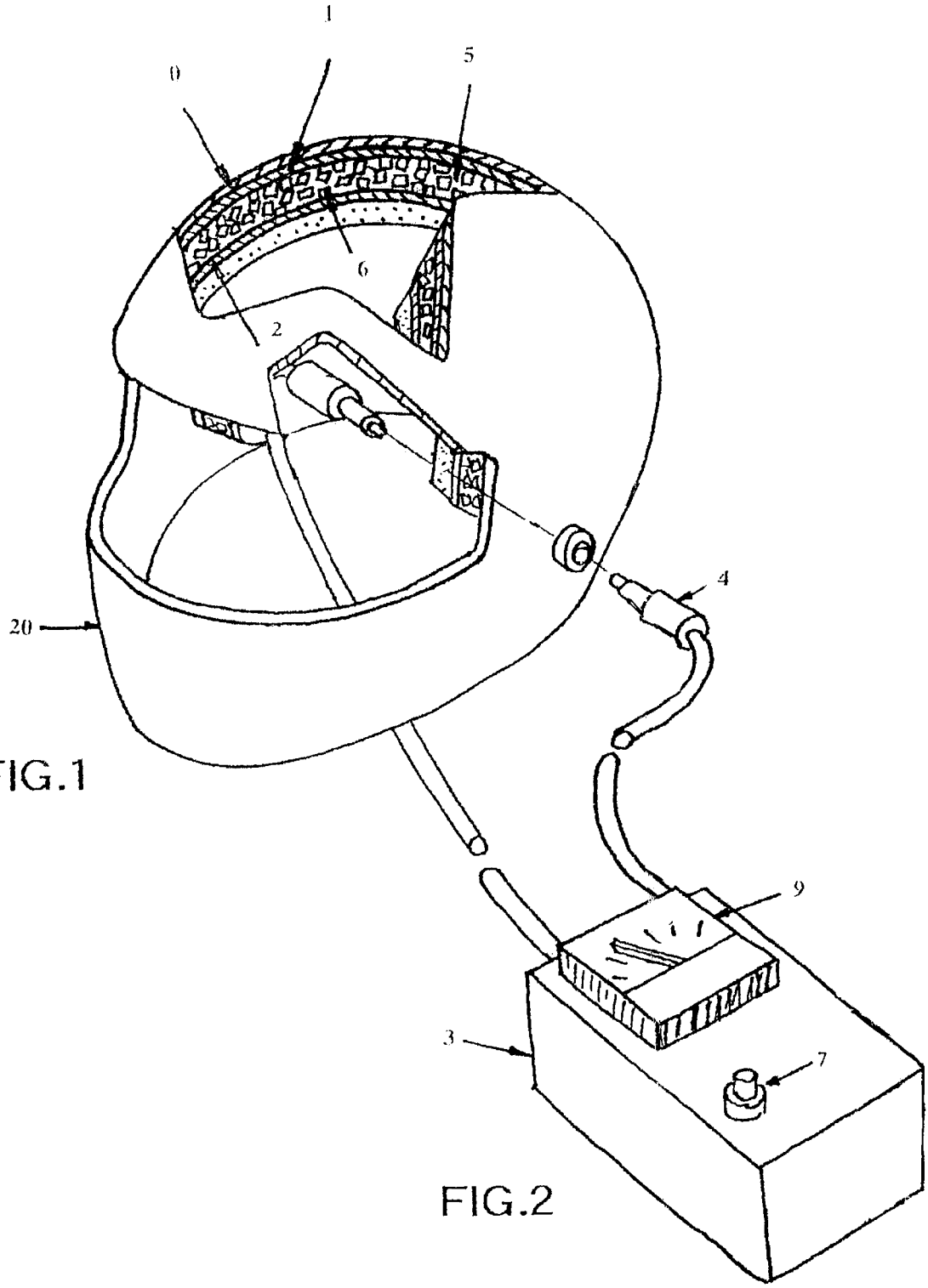
FIG. 1 is a perspective sectional view of an IC (Inner Cushion) according to a first embodiment of the present invention.
FIG. 2 is a perspective view of the micro-mechanism of the system to check the IC.

As shown in FIGS. 1 and 2, an Inner Cushion has, for instance, a shell (1) made of aluminum foil and a shock absorbing padding of Silica or Carbon Aerogel (6) fitted between the inner side of the shell (1) and the outer side of the shell (2). The shock absorbing cushion has a foamized or expanded material (5) which keeps all the different parts of the inner cushion bonded.

The IC of the present embodiment is constructed to protect the head of a wearer. Therefore, when the impact hits the helmet and reaches the IC from the outside part, the impact energy is absorbed by the filler materials.

The IC (1) has two shells (1) and (2) and a shock absorbing padding of Silica Aerogel, Carbon Aerogel or other energy absorbing material (6) with an expanded or foamized material (5) fitted and stuck on an inner and outer side of the shells (1) and (2)

The IC has an adhesive strip outside of the shells and between the shells in order to keep the IC compact and secure.

The IC has a box (3) system with panel (9) for checking the capacitance by pressing the button (7) and placing the jacks (4) into the IC metal foils.

Although there have been described what are the present embodiments of the invention, it will be understood by those skilled in the art that variations and modifications may be made thereto without departing from the gist, spirit or essence of the invention. The scope of the invention is indicated by the appended claims.

In the above embodiment, the present invention is applied to the full-face type helmet (20). Alternatively, the present invention can also be applied to helmets of other types, i.e., a jet-or semijet-type helmet, or a full face-type helmet serving also as a jet-type helmet. It could also be applied to impact-absorbing seats or to energy-absorbing materials placed between the driver's seat and the chassis in racing cars.

What is claimed is:

1. An Inner Cushion comprising:

a shock absorbing composite sandwiched between two protecting foils said composite including at least one absorbing material for absorbing an impact energy, wherein said at least one absorbing material is structured and arranged to absorb said impact energy by being crushed and collapsed upon exposure to said impact energy and diffusing air through a network of pores in said absorbing material.

2. The Inner Cushion as mentioned in claim 1, wherein an expanded or foamized material is mixed with Silica Aerogel or Carbon Aerogel or any other aerogel type material to constitute the shock absorbing composite.

3. The Inner Cushion as mentioned in claim 1, wherein EPS (Expanded Polystyrene) is mixed with Silica Aerogel, Carbon Aerogel or any other aerogel type material.

4. The Inner Cushion as claimed in claim 1, wherein EPP (Expanded Polypropylene) is mixed with Silica, Carbon Aerogel or any other aerogel type material.

5. The Inner Cushion as mentioned in claim 1, wherein EPE (Expanded Polyethylene) is mixed with Silica, Carbon Aerogel or any other aerogel type material.

6. The Inner Cushion as mentioned in claim 1, wherein MPS (Molded Polystyrene) is mixed with Silica Aerogel, Carbon Aerogel or any other aerogel type material.

7. The Inner Cushion as mentioned in claim 1, wherein MEPP (Molded Polypropylene) is mixed with Silica or Carbon Aerogel or any other aerogel type material.

8. The Inner Cushion as mentioned in claim 1, wherein MPE (Molded Polyethylene) is mixed with Silica or Carbon Aerogel or any other aerogel type material.

9. The Inner Cushion as claimed in claim 1, wherein a Foamed Polyurethane is mixed with Silica or Carbon Aerogel or any other aerogel type material.

10. The Inner Cushion as claimed in claim 1, wherein a Foamed Magnesium Silicate is mixed with Silica or Carbon Aerogel or any other aerogel type material.

11. The inner Cushion as claimed in claim 1, wherein a Foamed Magnesium Oxychloride is mixed with Silica or Carbon Aerogel or any other aerogel type material.

12. The Inner Cushion as mentioned in claim 1, wherein a Foamed Phenolic Foam is mixed with Silica or Carbon Aerogel or any other aerogel type material.

13. An inner cushion for helmets comprising:

a first shell;

a second shell;

a shock absorbing padding material arranged between said first and second shells, wherein said shock absorbing padding material is structured and arranged so that said padding material is crushed and collapsed upon the exposure of said material to an impact energy to thereby absorb said impact energy; and wherein said shock absorbing padding material arranged between said first and second shells is made of an inelastic material and wherein said shock absorbing padding material is structured and arranged so that air is diffused through a network of pores in said material upon the exposure of said material to an impact energy to thereby absorb said impact energy.

14. An inner cushion for helmets comprising:

a first shell;

a second shell;

a foam material arranged between said first and second shells;

an inelastic shock absorbing padding material suspended within said foam material, said inelastic material having a plurality of pores; and wherein said inelastic shock absorbing padding material is structured and arranged so that upon the exposure of said inelastic shock absorbing padding material to an impact energy an air flow is generated in said plurality of pores to thereby absorb a portion of said impact energy, and wherein said inelastic shock absorbing padding material is crushable and collapsable to thereby absorb a remaining portion of said impact energy.

15. The Inner Cushion as mentioned in claim 14, wherein said plurality of pores have a diameter in a mesopore range.

* * * * *